US010875348B1

(12) United States Patent
Taylor

(10) Patent No.: US 10,875,348 B1
(45) Date of Patent: Dec. 29, 2020

(54) GREETING ARTICLE

(71) Applicant: Lisa Murphy Taylor, Cincinnati, OH (US)

(72) Inventor: Lisa Murphy Taylor, Cincinnati, OH (US)

( * ) Notice: Subject to any disclaimer, the term of this patent is extended or adjusted under 35 U.S.C. 154(b) by 0 days.

(21) Appl. No.: 16/265,655

(22) Filed: Feb. 1, 2019

(51) Int. Cl.
*B42D 15/08* (2006.01)
*G09F 1/02* (2006.01)
*B42D 15/04* (2006.01)

(52) U.S. Cl.
CPC ..... *B42D 15/08* (2013.01); *B42D 15/045* (2013.01); *G09F 1/02* (2013.01)

(58) Field of Classification Search
CPC ..... B42D 15/08; G09F 1/02
USPC ..... 40/124.01, 514; 428/26; 493/955, 956
See application file for complete search history.

(56) References Cited

U.S. PATENT DOCUMENTS 3,274,045 A * 9/1966 Smith ..... A47G 11/001 428/26
4,490,940 A 1/1985 Geiges
4,524,541 A 6/1985 Geiges
5,236,748 A * 8/1993 Cheng ..... A41G 1/00 156/61
5,353,575 A * 10/1994 Stepanek ..... B65B 25/023 206/423
5,595,045 A 1/1997 Weder et al.
5,595,048 A 1/1997 Weder et al.
5,647,188 A 7/1997 Weder et al.
5,651,233 A 7/1997 Weder et al.
5,655,353 A 8/1997 Weder et al.
5,758,772 A 6/1998 Weder et al.
5,802,809 A 9/1998 Weder et al.
5,832,695 A 11/1998 Weder et al.
5,955,158 A 9/1999 Wilkins
6,159,563 A 12/2000 Aycock Whitlock
6,195,962 B1 3/2001 Weder et al.
6,341,471 B2 1/2002 Weder et al.
(Continued)

FOREIGN PATENT DOCUMENTS

EP 0 673 858 9/1995

OTHER PUBLICATIONS

"Christmas Bell Greeting Card on Old Paper Scroll", AP Images, Sep. 13, 2018, http://www.apimages.com/metadata/MSIndex/Christmas-bell-greeting-card-on-old-paper-scroll/222380954/222/0 (1 page).

(Continued)

*Primary Examiner* — Joanne Silbermann
(74) *Attorney, Agent, or Firm* — Daniel F. Nesbitt; Hasse & Nesbitt LLC

(57) ABSTRACT

A decorative greeting article comprising a sheet of paper having a written inscription inscribed upon its center portion, readable in an unrolled position, and formable into a rolled cylinder having a hollow interior and an opening in a rolled position. The opening of the cylinder can receive a decorative member which can be a natural or an artificial flower or a bouquet of flowers or other novelty item, and a stem part that extends into the hollow interior of the cylinder. A securing means, optionally decorative, including an adhesive surface, releasably secures the sheet of paper in the rolled, cylinder position. A user can grasp and pull a pull tab to release the securing means from the cylinder, releasing the sheet to be unrolled and viewed by the user.

6 Claims, 13 Drawing Sheets

(56) References Cited

U.S. PATENT DOCUMENTS

| | | | | |
|---|---|---|---|---|
| 6,832,445 | B2 * | 12/2004 | Pitzen | A47G 1/175 40/594 |
| 9,649,875 | B2 | 5/2017 | Patel et al. | |
| 2001/0001919 | A1 | 5/2001 | Weder et al. | |
| 2002/0095844 | A1 | 7/2002 | Slavik | |
| 2003/0121187 | A1 | 7/2003 | Ryan | |
| 2003/0173246 | A1 | 9/2003 | Weder et al. | |
| 2014/0161997 | A1 * | 6/2014 | Patel | B44C 5/06 428/26 |
| 2015/0336415 | A1 * | 11/2015 | Fetters | B42D 15/042 40/124.09 |

OTHER PUBLICATIONS

"Scroll Invitation Card, Scroll Invitation—Khatte Meethe Desires", IndiaMart, marketed prior to Nov. 12, 2018, https://www.indiamart.com/proddetail/scroll-invitation-card-18963075533.html (6 pages).

"Khatte Meethe Desires Paper Customised Gift Scroll Card", Amazon.in Office Products, marketed prior to Nov. 12, 2018, https://www.amazon.in/Khatte-Meethe-Desires-Customised-Scroll/dp/B01I794J4S (6 pages).

* cited by examiner

GREETING ARTICLE

FIELD OF THE INVENTION

The present invention relates to greeting articles, and methods of using such greeting articles.

BACKGROUND

Greeting articles such as greeting cards are used to convey messages and greetings. Messages can include correspondence letters and memorandums while greetings can range from being a simple "Hello" to anniversary greetings, birthday greetings, or holiday greetings. One utility of the greeting card is that it serves as a souvenir to the receiver from the sender. The greeting card also serves to evoke pleasantness in the receiver by addressing/appealing to the individual receiver in some manner typically at the time the receiver receives the greeting card for the first time. For example, this could be a thought that he or she is being remembered by the sender.

Senders usually resort to choosing greeting cards based on target receivers and the target receivers' particular taste. It is also true that manufacturers of greeting cards usually conduct laborious market research into people's preferences when designing their products. As a result, a number of innovations have happened in the field of greeting articles, generally, for example, U.S. Patent Nos. like U.S. Pat. Nos. 5,595,045, 6,159,563, 9,649,875 B2, the disclosures of which are incoporated herein by reference in their entireties. Generally, most of these innovations' utility has been directed towards the articles merely serving as an artifact or a souvenir or otherwise to merely evoke pleasantness in the receiver.

A utility that serves to touch upon higher aspects such as philosophical intrigue, unconscious reflections, or the like in human beings has not yet been addressed thus far. Thus, there exists a need in the current art to achieve such robust greeting articles.

SUMMARY OF THE INVENTION

The present invention provides a decorative greeting article that includes a sheet, typically a sheet of paper, a pull tab, a securing means, and an optional decorative item. The sheet can also be comprised of plastic, fabric, cardboard, or other like materials. The sheet has a greeting or other inscription inscribed thereupon and has a proximal edge portion and an opposed distal edge portion. The sheet is configured to extend from the distal edge portion to the proximal edge portion in an unrolled position at which the greeting or other inscription can be seen, and to be rolled from proximal edge portion to the distal edge portion to a rolled position, to form an elongated cylinder comprising two or more spiral layers of the sheet. The elongated cylinder has a hollow interior, and an opening into the hollow inerior at at least one end.

The securing means releasably attaches the distal edge portion of the sheet onto the outermost spiral layer of the sheet in the rolled position. When a sufficient pulling force is applied onto the pull tab, the securing means can be released, allowing the distal edge portion of the sheet to separate from the outermost spiral layer of the sheet of paper, for unrolling the sheet of paper to its unrolled position. The optional decorative item has a stem or elongated projection that can be inserted through the opening and into the hollow interior of the cylinder.

The invention also provides a decorative greeting article that includes (a) a sheet having a greeting or other inscription inscribed thereupon, the sheet having a proximal edge portion and an opposed distal edge portion, wherein the sheet is configured to extend from the proximal edge portion to the distal edge portion at an unrolled position at which the greeting or other inscription can be seen, and to be rolled from the proximal edge portion to the distal edge portion at a rolled position, to form an elongated rolled cylinder comprising two or more spiral layers of the sheet, wherein the distal edge portion is rolled onto the outermost spiral layer of the sheet, the rolled cylinder having a hollow interior, and an opening into the hollow interior at one end; (b) a pull tab extending from the distal edge portion of the sheet; (c) a securing means for releasably attaching the distal edge portion of the sheet onto the outermost spiral layer of the rolled cylinder in the rolled position, wherein the securing means is released when a pulling force sufficient is applied onto the pull tab, which releases the distal edge portion of the sheet from the outermost spiral layer of the rolled cylinder, for unrolling the sheet to its unrolled position; and (d) an optional decorative item having a stem that is configured to be inserted through the opening and into the hollow interior of the rolled cylinder.

The invention also provides a decorative greeting article, that includes: (a) an elongated spool having an outer surface, a hollow interior, and an opening into the hollow interior at one end; (b) a sheet having a greeting or other inscription inscribed thereupon, the sheet having a proximal edge portion and an opposed distal edge portion, wherien the proximal edge portion of the sheet is attached to the outer surface of the elongated spool, wherein the sheet is configured to extend from the attached proximal edge portion on the outer surface, at an unrolled position at which the greeting inscribed thereon can be seen, and to be rolled around the outer surface of the elongated spool to the distal edge portion at a rolled position, to form an elongated rolled cylinder comprising two or more spiral layers of the sheet, wherein the distal edge portion is rolled onto the outermost spiral layer of the sheet of paper; (c) a pull tab extending from the distal edge portion of the sheet; (d) a securing means for releasably attaching the distal edge portion of the sheet onto the outermost spiral layer of the rolled cylinder in the rolled position, wherein the securing means is released when a pulling force sufficient is appplied onto the pull tab, which releases the distal edge portion of the sheet from teh outermost spiral layer of the rolled cylinder, for unrolling the sheet to its unrolled position; and (e) an optional decorative item having a stem that is configured to be inserted through the opening and into the hollow interior of the spool.

In an embodiment of the invention, the securing means comprises an adhesive strip comprising a flexible material having an adhesive inner surface, having a proximal end integrably attached to the distal edge portion of the sheet, and an adhesive securing area configured to be wrapped around and adhere to the outer surface of an outermost spiral layer of the rolled cylinder.

In an embodiment of the invention, the pull tab comprises a separate tab member having a proximal edge, and a distal end of the adhesive strip is attached adhesively and integrably to the proximal edge of the tab member.

In an embodiment of the invention, the pull tab is formed by a distal end of the adhesive strip that has been folded inwardly and over onto an adjacent portion of the adhesive strip, to form a self-adhered tab portion.

In an embodiment of the invention, the adhesive inner surface comprises a pressure-sensitive adhesive.

In an embodiment of the invention, the pull tab has a shape of a leaf.

In an embodiment of the invention, the sheet is a sheet of paper.

In an embodiment of the invention, the greeting or other inscription is any of a mechanically-printed form, a hand-written form, an embroidered form, or a combination thereof.

In an embodiment of the invention, the sheet of paper is rolled from the proximal edge portion, and in some embodiments, from the proximal corner, to an opposed distal corner.

In an embodiment of the invention, the distal edge portion of the sheet comprises a distal corner of the sheet, and the securing means comprises an adhesive patch affixed to a front surface of the distal corner, for securing the distal corner of the sheet to the outermost layer of the rolled cylinder.

In an embodiment of the invention, the pull tab comprises a separate tab member having a proximal edge, and the proximal edge of the tab member is attached to the distal corner of the sheet, and configured for applying a pull force onto the distal corner of the sheet for peeling the adhesive patch away from the outermost layer of the rolled cylinder.

In another embodiment of the present invention, the proximal edge portion comprises a corner of the sheet, and the opposed distal edge comprises an opposite corner of the sheet.

In an embodiment of the invention, the sheet of paper is scented.

In a further embodiment of the present invention, the sheet is a sheet of paper that is scented with an odiferous agent, typically on its greeting-inscribed side.

In another embodiment of the present invention, the elongated spool is made of a resilient material selected from the group consisting of cardboard, paper film, plastic, and aluminum, and a combination or laminate thereof, and preferably, in another embodiment, the elongated cylinder is a tube.

In yet another embodiment of the present invention, the sheet is a sheet of paper that is triangular in shape, and the proximal edge portion is a base of the triangle, and the distal edge portion is a corner of the triangle opposite the base.

DETAILED DESCRIPTION OF THE INVENTION

Figure 2:
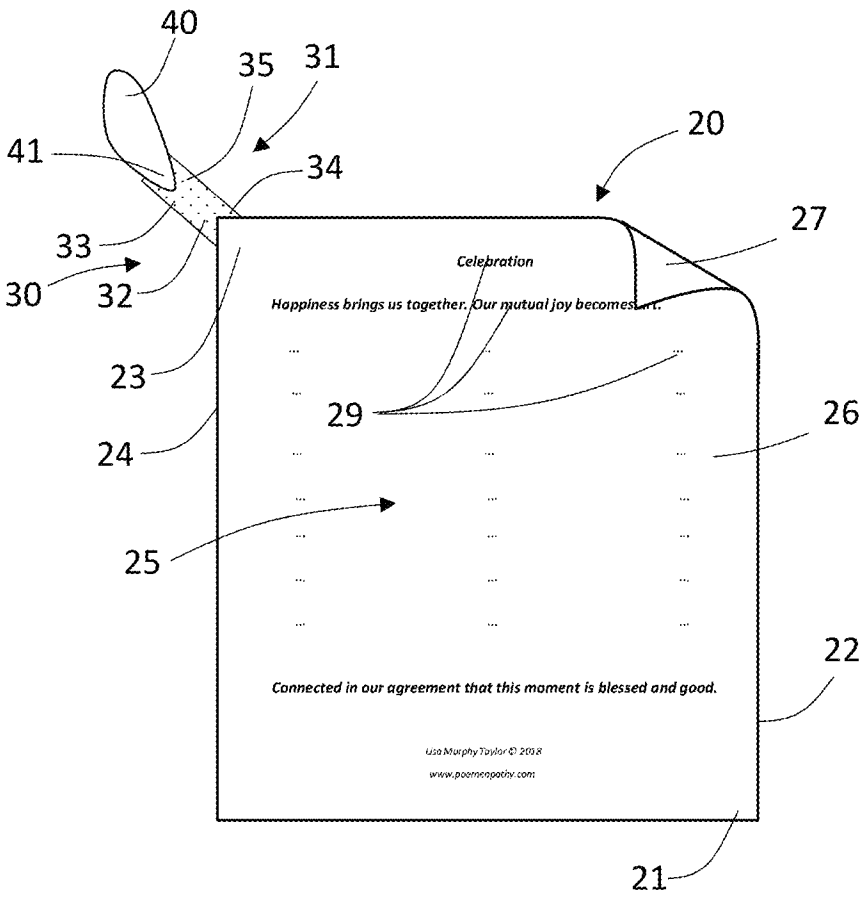
FIG. 2 shows the sheet without the decorative flower and in an unrolled position.
Figure 1:
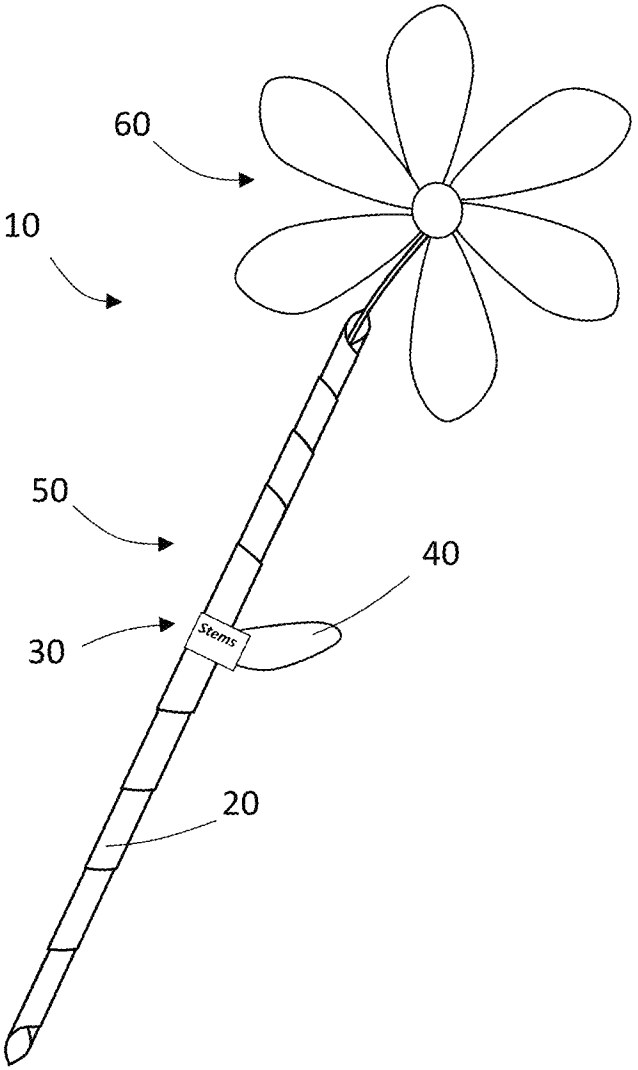
FIG. 1 shows a decorative greeting article according to the invention having a decorative item shown as a flower inserted onto a cylinder achieved by rolling and securing a sheet into a cylinder.

FIG. 1 shows a decorative greeting article 10 that includes a sheet 20 rolled into a cylinder 50, referred to hereinafter as a "rolled position", and a decorative item 60. The sheet 20, as shown in FIG. 2 in an unrolled position, is typically defined by four side edges and four associated side corners, and is square or rectangular in shape. The sheet 20 is typically made of paper, but other flexible and resilient materials known in the art, such as a plastic film, a paperboard, or a fabric, or a combination or laminate thereof, can be used. The sheet 20 comprises a first or proximal corner 21 in a proximal side edge 22, a second or distal corner 23 in a distal side edge 24 and which distal corner 23 is diagonally opposite to the first or proximal corner 21, an inscription area 25, and a securing means 30 to secure the sheet 20 in teh form of the cylinder 50.

The securing means 30, as mentioned, serves to secure the sheet 20 in the form of the cylinder 50 while in the rolled position. The securing means is releasable, for releasably attaching the distal edge portion onto an outermost spiral layer of the rolled cylinder in the rolled position. A pull tab is provided, on which a pulling force can be applied for releasing the securing means, and pulling the distal edge portion of the sheet from the outermost spiral layer of the rolled cylinder.

In the illustrated embodiment as shown in FIG. 2, a first embodiment of the securing means 30 is an adhesive strip 31 having an adhesive 32 on a first or inner surface 33, and is typically made of resilient and/or flexible material, such as a paper, fabric or plastic film, or a combination or laminate thereof, and can be the same material used to make the sheet 20. The adhesive 32 is typically a pressure-sensitive adhesive though other types of adhesives can be used. The pressure-sensitive adhesive can be an adhesive material selected from the group consisting of acrylic, rubbger, ethylene vinyl acetate (EVA), silicone, and polyurethane. The pressure-sensitive adhesive can be a hot-melt adhesive, a water-based adhesive, or a solvent-based adhesive. The pressure-sensitive adhesive surface is preferentially releasable from the outer surface of the shaft 50 of rolled paper.

In another embodiment, the adhesive strip can be integral and contiguous with the sheet 20, extending from the distal corner 23 of the paper 20, and having an adhesive surface on the inner surface thereof.

Figure 3:
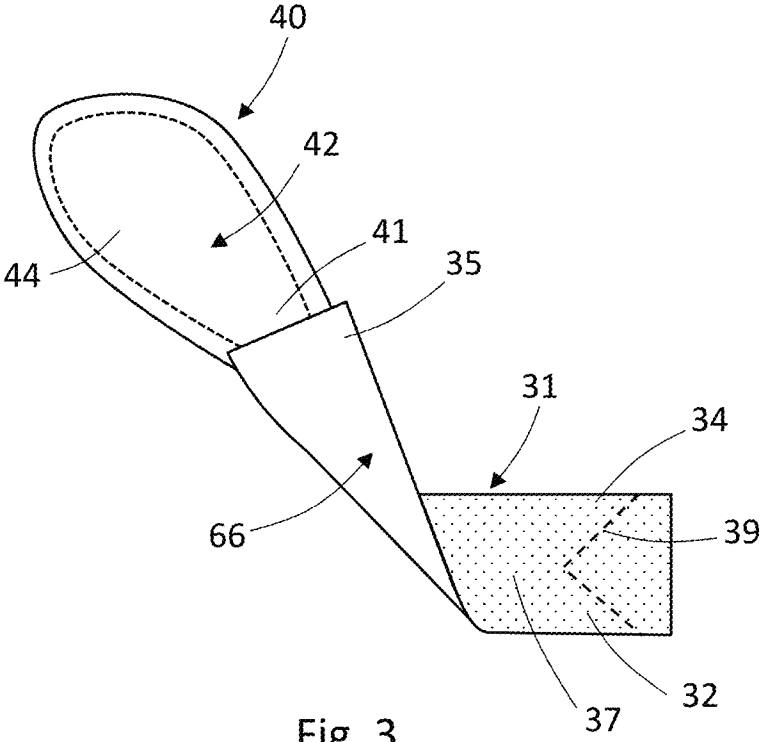
FIG. 3 shows an adhesive strip attached to a pull tab for use as a means for securing the rolled sheet into the cylinder.

As shown in FIGS. 2 and 3, a proximal end 34 of the adhesive strip 31 is integrably attached at the distal corner 23 on a reverse or outside surface 27 of the sheet 20, onto a proximal portion of the strip 31 as defined by the dashed lines 39. A distal end 35 of the adhesive strip 31 is integrably attached to an attaching end 41 of a tab member 40. "Integrably" attached means the proximal and distal ends remain attached to the respective distal corner 23 of the sheet 20 and the tab member 40 during normal use, including when the securing means is released and sheet is unrolled. The tab member 40 is a separate pull tab, and can be made of the same or different material as the sheet 20, and can also bne made of other flexible and resilient materials known in the art, including a plastic film, a paper or paperboard, or a fabric, or a combination or laminate thereof. The tab member 40 can have any shape, though in the illsutrations it has the shape of a leaf. In the illustrated embodiment, the sheet 20 and the tab member 40 remain attached to the opposed ends 34, 35 of the adhesive strip 31, respectively, exposing an adhesive securing area 37 of the adhesive strip 31 therebetween.

Figure 4:
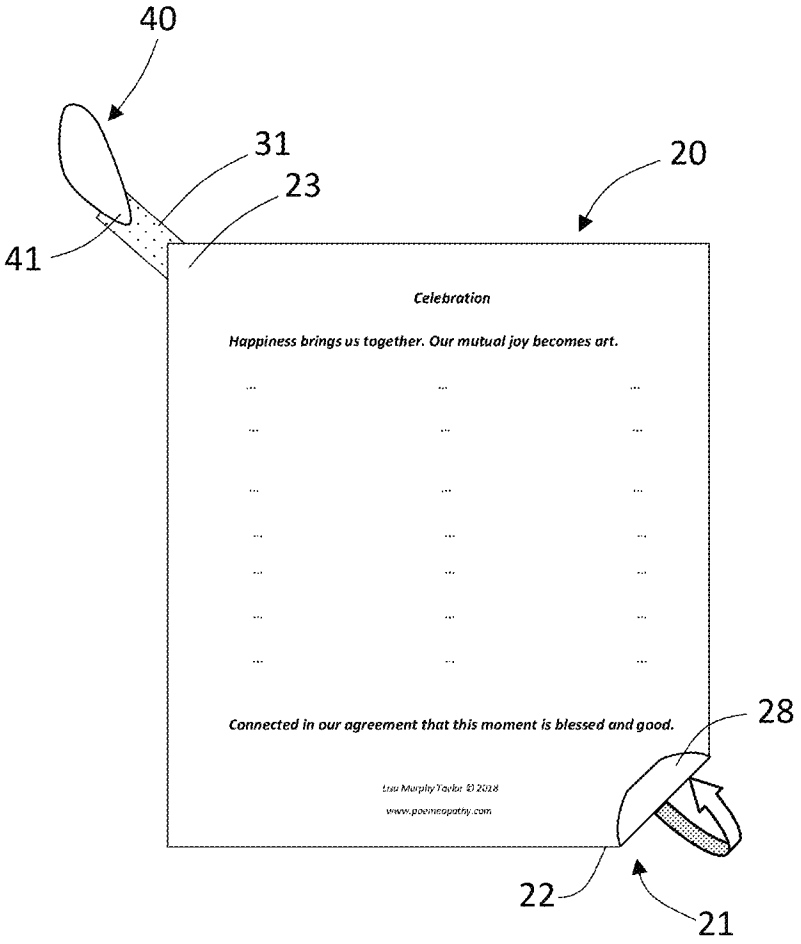
FIG. 4 illustrates a proximal corner of the sheet being rolled toward the opposite distal corner of the sheet.
Figure 6:
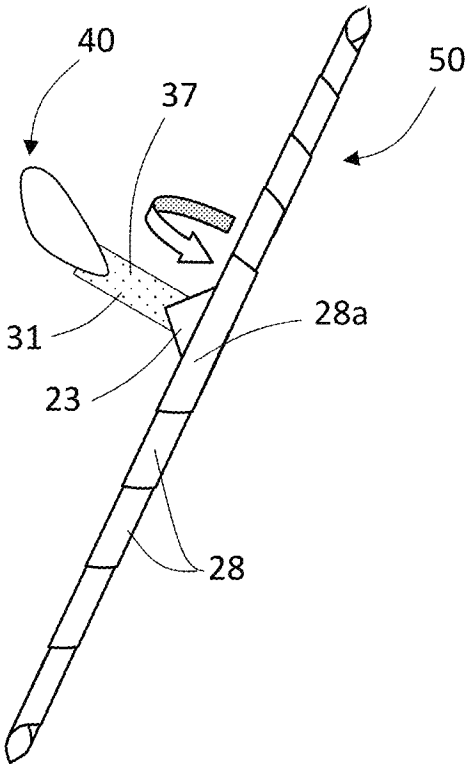
FIG. 6 shows the spiral layers of the sheet being rolled into the cylinder with the adhesive strap extending from the distal corner of the sheet.
Figure 5:
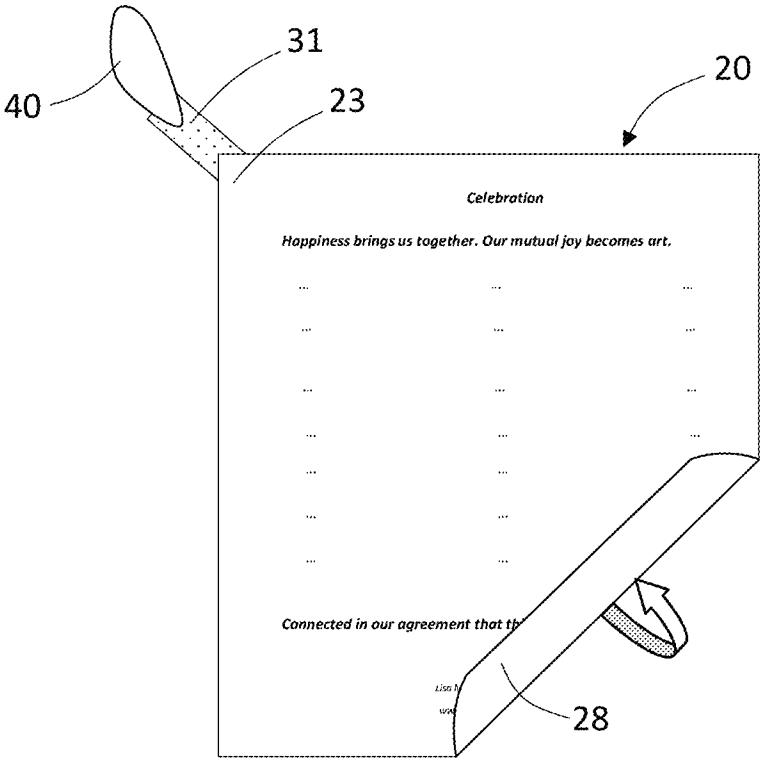
FIG. 5 shows the sheet being further rolled into one or more spiral layers of the sheet.
Figures 7, 8:
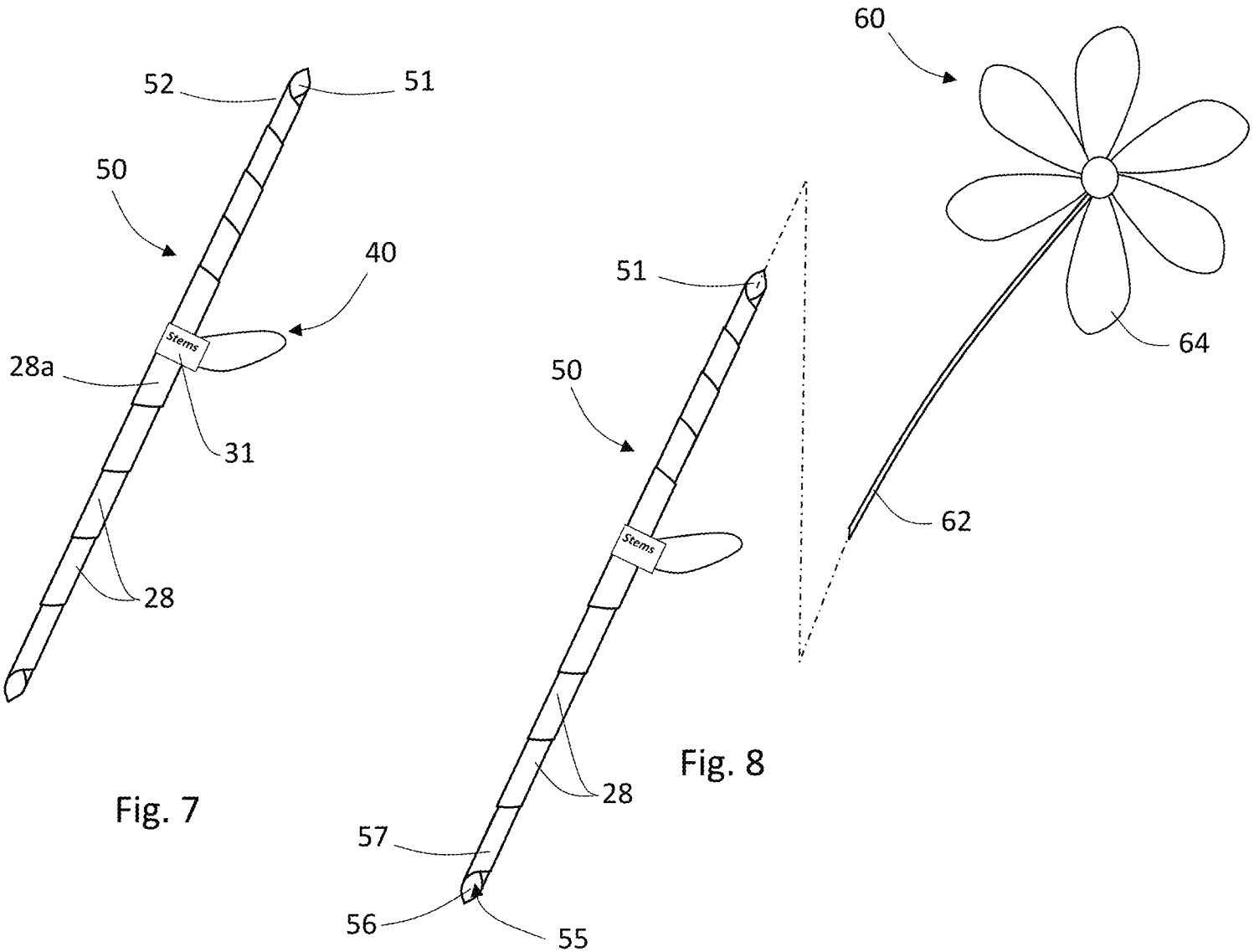
FIG. 7 shows the fully formed cylinder held in place with the adhesive strip.
FIG. 8 illustrates the decorative flower being inserted through the openign and into the cylinder.

FIGS. 4-8 illustrate the steps involved in forming the decorative greeting article 10 from the sheet 20. Referring to FIG. 4, the proximal corner 21 of the sheet 20 is folded in or rolled inwardly, toward the opposite distal corner 23 of the sheet 20, and further rolled toward the distal corner 23 as shown in FIG. 5, creating a plurality of spiral layers 28 of the sheet 20, each spiral layer being rolled on top of an inner spiral layer, until the rolled spiral layers 28 reach the distal corner 23, forming a cylinder 50, as shown in FIG. 6. The adhesive strip 31 attached to and extending from the distal corner 23 of the sheet 20, is then rolled over and around the outermost spiral layer 28*a* of the cylinder 50, so that the adhesive securing area 37 of the adhesive strip 31 adheres to and around the outer surface of the outermost layer 28*a* of the cylinder 50, thereby securing the sheet 20 in the form of the cylinder 50 as shown in FIG. 7. The tab member 40 remains attached to the distal end 35 of the adhesive strip 31, while its body is unattached to the outer surface of the cylinder 50. This aids the user in grasping the free and unattached body of the tab member 40, while also appearing to be a leaf, adding to the aesthetic appearance of the decorative greeting article 10.

Although the same adhesive material is being used to adhere the proximal end 34 of the adhesive strip 31 to the distal corner 23 of the sheet 20, to adhere the distal end 35 of the adhesive strip 31 to the tab member 40, and to adhere the adhesive securing area 37 of the adhesive strip 31 to the outer surface of the outermost layer 28*a* of the cylinder 50, the pulling force applied on the tab member 40 by the user applies a peel force that preferentially releases the adhesive securing area 37 from the outermost layer 28*a* of the cylinder 50, while applying a shear force along the ends of the adhesive strip 31 attached to the distal corner 23 and the tab member 40, which would require significantly greater force shear and separate the adhesive strip 31 from either the second or distal corer 23 of the sheet 20 or the tab member 40. In an embodiment, a different or additional adhesive can be applied at the ends of the adhesive strip 31, to more securely adhere them to the distal corner 23 and the tab member 40.

The cylinder 50 has an upper opening 51 at a first end 52, an outer surface defined by the plurality of spiral layers 28, an inner surface, a hollow interior 55, and a second opening 56 at a second end 57. As shown in FIG. 8, a decorative item 60 that includes a flower portion 64 and a stern 62 having a length typically shorter than the length of the cylinder 50, and a width or diameter typically smaller than the width or diameter of the inner surface of the cylinder 50. The stem 62 is inserted through the opening 51 at the first end 52 and into the hollow interior 55 of the cylinder 50, with the flower portion 64 extending from the opening 51 and visible in the rolled position. In other embodiments, an elongated shaft can extend from the decorative item.

As shown in FIG. 2, the inscription area 25 of the sheet 20 typically includes an inscription greeting 29 that is inscribed in a center, or interior portion of the sheet 20. The inscription area 25 generally includes the entirety of the sheet 20 but can be restricted to certain portions in the sheet 20 based on user preferences. In some embodiments, the inscription area 25 of the sheet 20 is scented or is infused with an odiferous agent to provide a pleasant scent or aroma to the sheet 20, such as a perfume.

Figure 17:
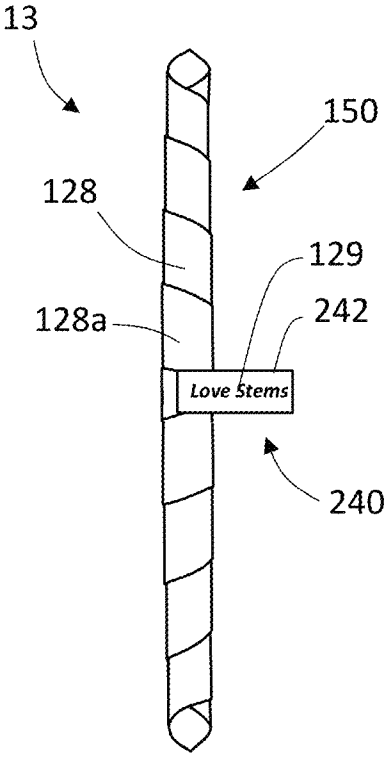
FIG. 17 shows the fully formed cylinder of FIG. 16, held in place with the adhesive tab securing the cylinder in position.

The pull tab, illustrated as the tab member 40, can also include an inscription area 42 on a reverse surface 44 as shown in FIG. 3, upon which a second inscription or written material can be inscribed (exemplified by an inscription 129 on adhesive pull strip 240 of FIG. 17). Alternatively, the second inscription area also can be, or optionally be, on the inside surface of the tab member 40. FIG. 3 shows the adhesive strip 31 having the outer-facing surface 66, opposite the adhesive 32 surface. A third inscription or written material can also be inscribed within an inscription area on the outer surface 66 of the adhesive strip 31. The inscription (s) associated with the sheet 20, the adhesive strip 31, and the tab member 40 can be used and can depend upon user and market preferences, and can be related in substance and form to each other.

When a user wishes to open the decorative greeting article 10, the user may remove (optionally) the decorative item 60 from the hollow interior 55 of the cylinder 50. Then, gripping the tab member 40, the user can apply a sufficient force onto the tab member 40 and the distal end 35 of the adhesive strip 31 to release the adhesive 32 in the adhesive securing area 37 of the adhesive strip 31 from the outermost layer 28*a* of the cylinder 50, to release and separate the near corner 23 of the sheet from the cylinder 50. The user can then unroll and open the sheet 20 to reveal the inscription 29. After the user has finished interacting with the inscription 29, the user may re-roll the sheet 20 back into the rolled position, and re-secure the adhesive strip 31 onto the outside surface 27 of the outermost layer 28*a* of the cylinder 50.

Figure 10:
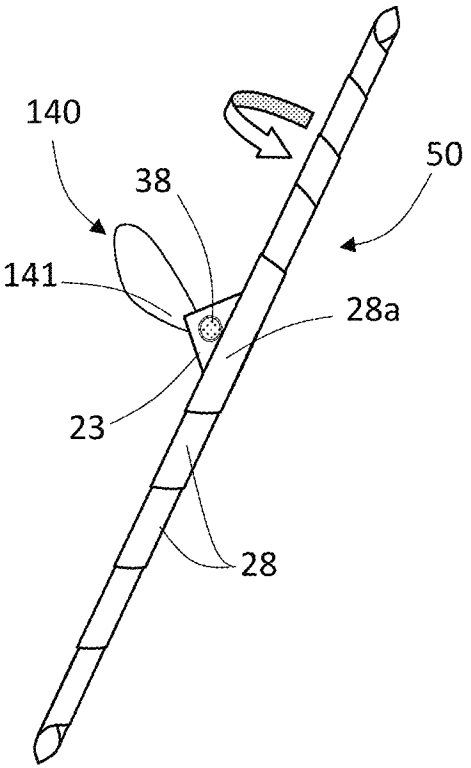
FIG. 10 shows the spiral layers of the sheet of FIG. 9, rolled into the cylinder with the pull tab extending from the near corner of the sheet, and showing the adhesive patch applied in the fastening zone.
Figure 9:
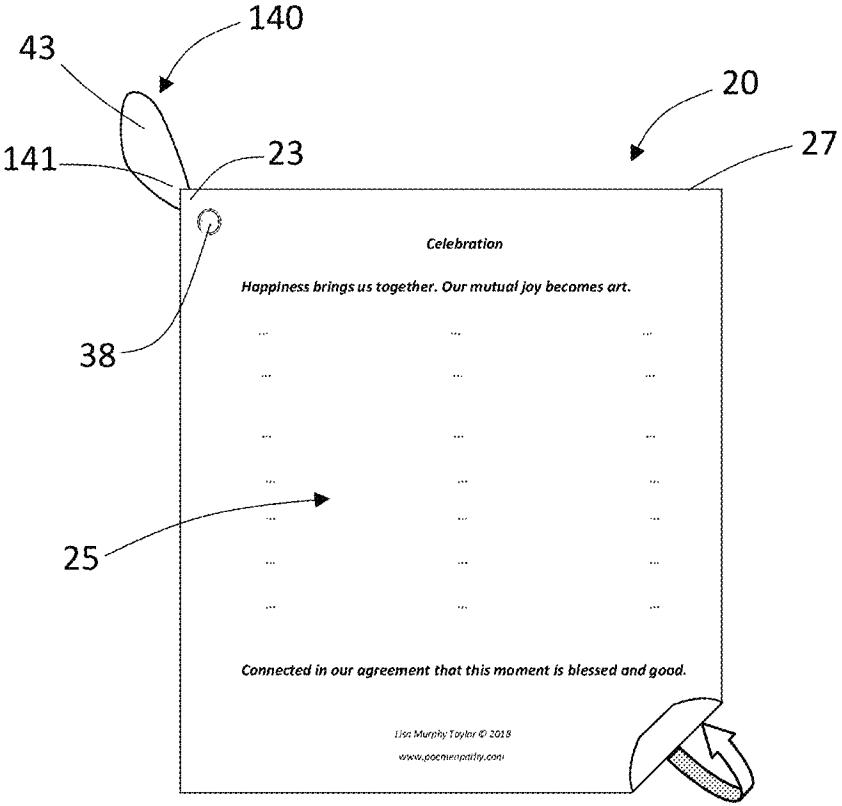
FIG. 9 shows an alternative embodiment of a sheet with an adhesive patch applied in a fastening zone in the near corner of the sheet, as an alternative means for securing the rolled sheet into the cylinder.
Figure 11:
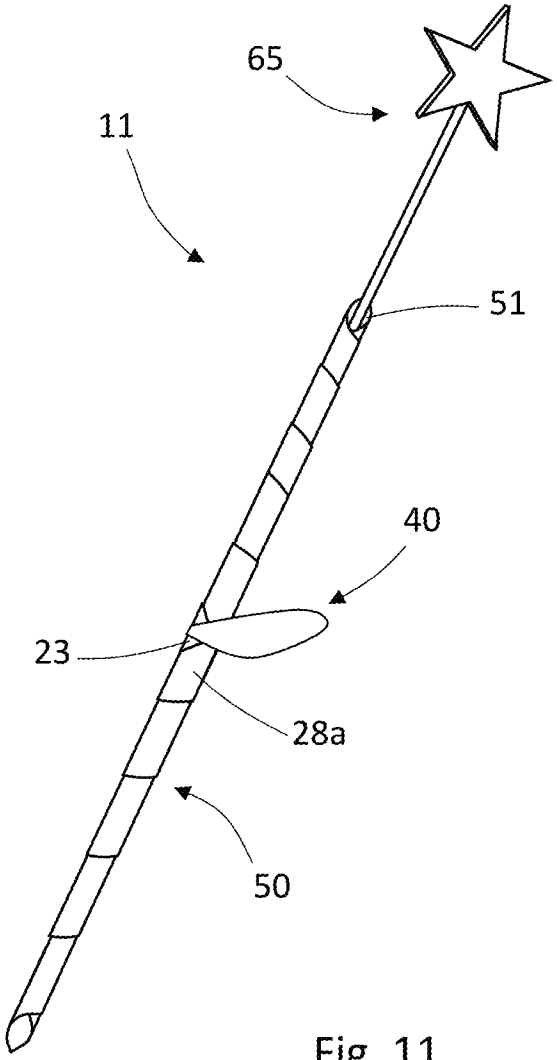
FIG. 11 shows the fully formed cylinder of FIG. 10, held in place with adhesive patch of the near corner of the sheet securing the sheet cylinder in position, and having a decorative item shown as a fairy's wand.

FIGS. 9-11 show another alternative embodiment of a pull tab and a securing means for a decorative greeting article 11. The securing means comprises an adhesive patch 38 affixed to the inside surface 26 of the distal corner 23 of the sheet 20. The decorative item is shown as a fairy's wand 65. The adhesive patch 38 can have a shape and a size sufficient to present an adhesive surface for securing the inside surface 26 of the distal corner 23 of the sheet to the outermost layer 28*a* of the rolled cylinder 50. The adhesive material can be selected to provide releasable adhesion of the distal corner 23 to the cylinder 50, as shown in FIGS. 10 and 11, so that the corner 23 can be released from the cylinder 50 when a peeling force is applied. The adhesive material of the adhesive patch 38 can be the same as the adhesive 32 of the adhesive strip 31 described herein earlier. The pull tab is illustrated as a tab member 140 that is attached directly at its proximal, attaching end 141 to the outside surface 27 of the distal corner 23 of the sheet, typically by an adhesive material. In one embodiment, the adhesive material that attaches the tab member 140 to the distal corner 23 adheres more securely than does the adhesive patch 38 adhere to the outermost layer 28*a* of the cylinder 50, so that the tab member 140 remains fixed to the sheet 20 when the cylinder 50 is released and unrolled. The body of the tab member 140 typically remains free from attachment to the cylinder 50, for easy access to the user and/or aesthetics. The sheet 20 in this embodiment can be the same as in the previous embodiment, and can be rolled, unrolled, and re-rolled, in the same manner as earlier described.

Figure 12:
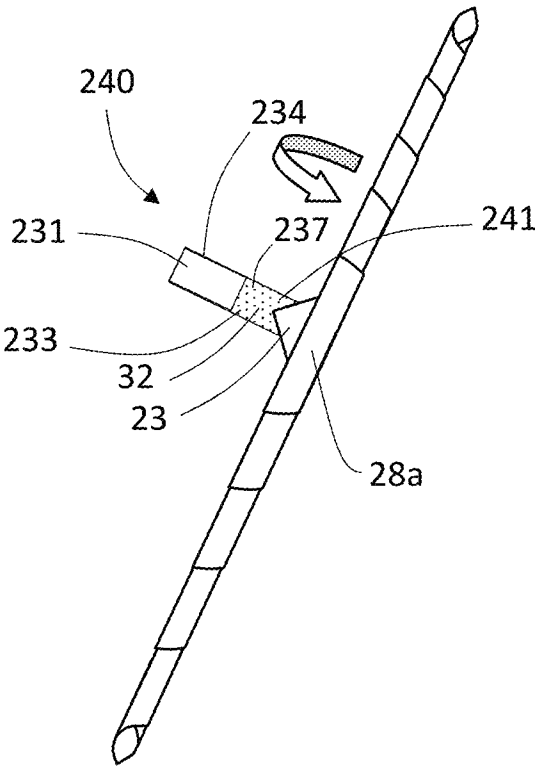
FIG. 12 shows another embodiment of an adhesive tab as a means for securing the sheet into the cylinder.
Figure 13:
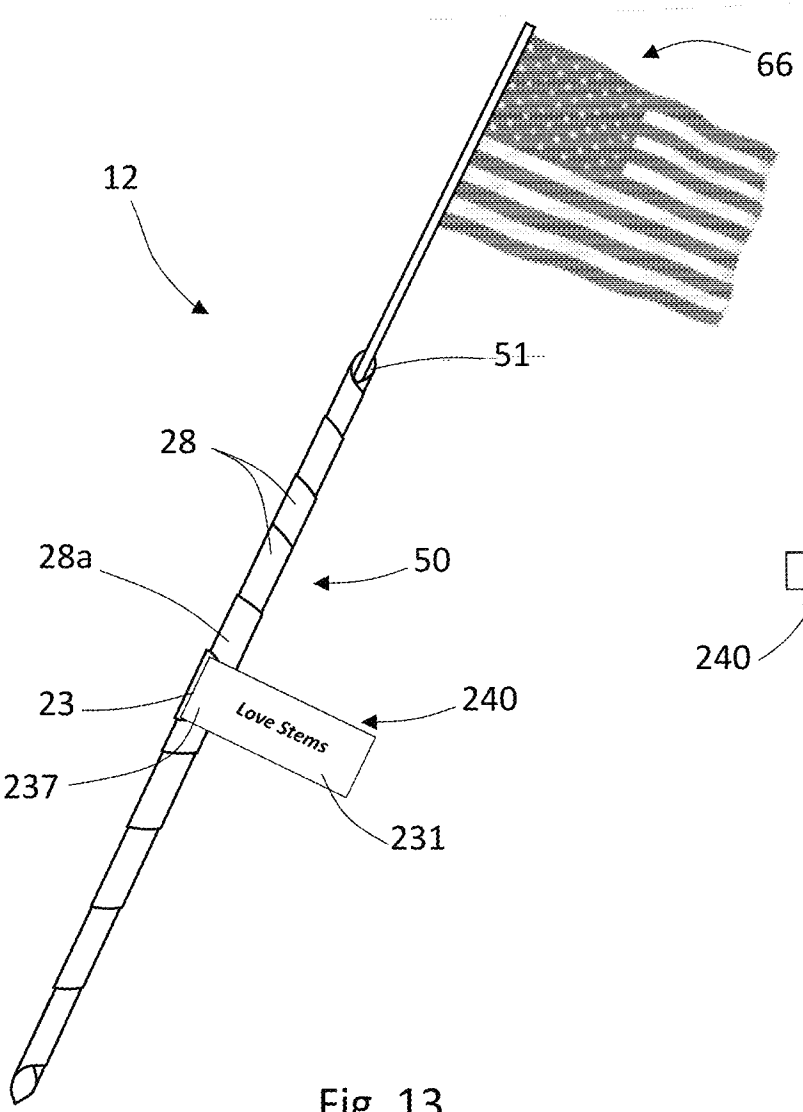
FIG. 13 shows the fully formed cylinder of FIG. 12 held in place with the adhesive tab securing the cylinder in position, and having a decorative item shown as a flag.

FIGS. 12-13 show another alternative embodiment of a pull tab and a securing means for a decorative greeting article 12, comprising an adhesive pull strip 240. The adhesive pull strip 240 is similar in some features to the embodiment of the adhesive strip 31. The decorative item is shown as a flag 66 having a stem 62 extending from the open end 51 of the cylinder 50. The adhesive pull strip 240 comprises a strip of material 241 having an adhesive 32 on an inner surface 233, an outer surface 234, and tab portion 231 at the distal end of the adhesive pull strip 240. The distal portion of the inner surface 233 of the adhesive strip 241 can be folded over onto itself, to form the self-adhered tab portion 231, which provides a pull tab. An adhesive securing area 237 is provided between the tab portion 231, and a proximal portion 234 of the adhesive strip 241 of material that attaches to the distal corner 23 of the sheet 20. FIG. 12 shows the adhesive pull strip 240 secured to the distal corner 23 of the sheet 20, and extending from the cylinder 50. The adhesive pull strip 240 is then rolled over and around the outermost spiral layer 28*a* of the cylinder 50, so that the adhesive securing area 237 adheres to the outer surface of the outermost layer 28*a* of the cylinder 50, thereby securing the sheet 20 in the form of the cylinder 50 as shown in FIG. 13. Although the same adhesive material can be used to adhere the distal end 234 of the adhesive strip 241 of material to the distal corner 23 of the sheet 20, and to adhere the adhesive securing area 237 to the outermost layer 28*a* of the cylinder 50, the pulling force by the user applied through the pull tab, applies a peel force that preferentially releases the adhesive securing area 237 from the outermost layer 28*a* of the cylinder 50, while as applying a shear force along the adhesive strip 241 of material attached to the distal corner 23, which is believed to require significantly greater force to shear and separate the proximal portion 234 of the adhesive strip 241 from the distal corner 23 of the sheet.

Griping the tab portion 231, the user can apply a sufficient force onto the adhesive pull strip 240 to peel and release the adhesive securing area 237 from the outermost layer 28*a* of the cylinder 5, thereby releasing and separating the distal corner 23 of the sheet from the cylinder 50, and allowing the user to unroll and open the sheet 20, and reveal the inscription 29.

In an embodiment, a different or additional adhesive can be applied at the ends of the tab member 40, to more securely adhere it to the distal corner 23.

Figure 14:
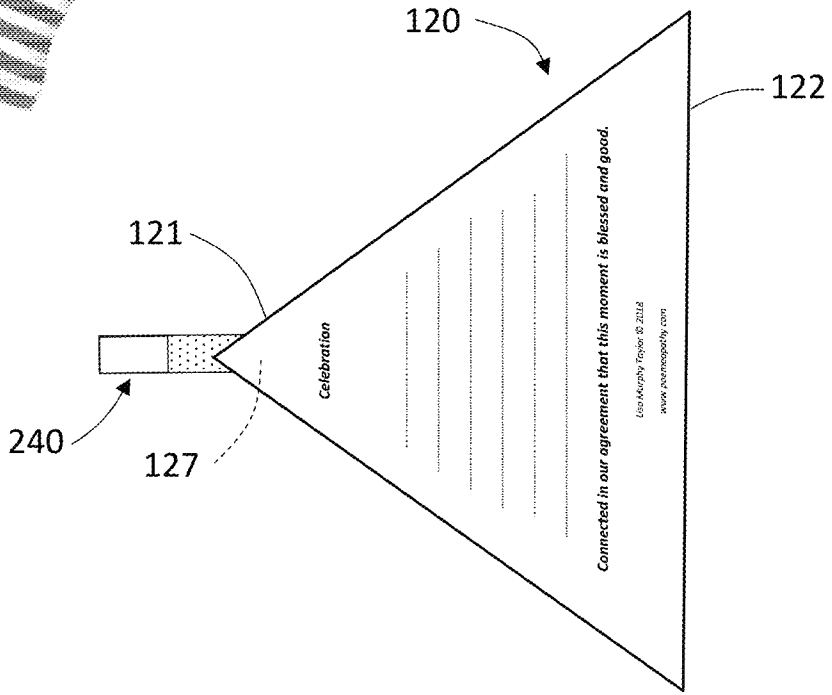
FIG. 14 shows an alternative embodiment of a sheet having a triangular shape, with an adhesive tab attached at a vertex corner.
Figure 16:
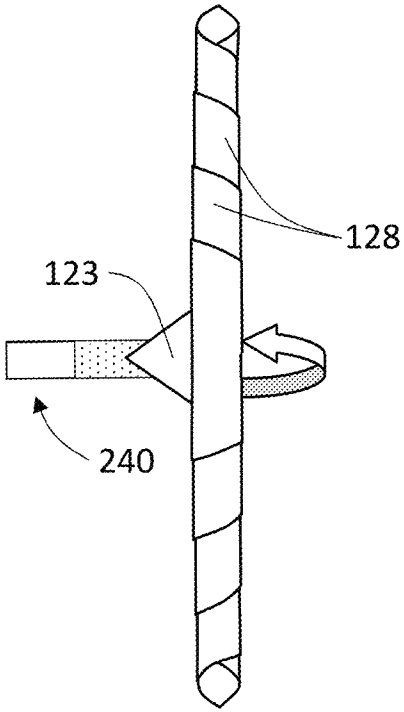
FIGS. 15 and 16 show rolling of the triangular sheet of FIG. 14 from a side edge toward the opposite vertex corner of the sheet.
Figure 15:
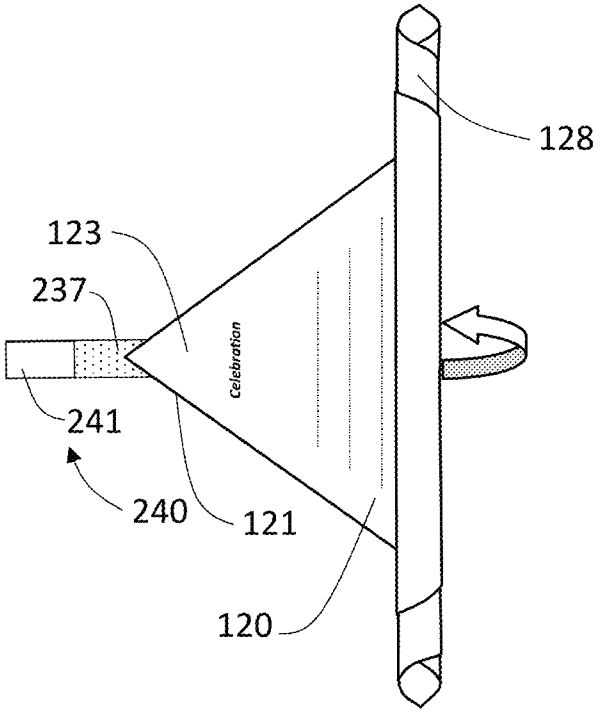

FIGS. 14-17 show another alternative embodiment of a decorative greeting article 13, where a sheet 120 has the shape of a triangle, and specifically, an equilateral triangle. In this embodiment, the pull tab and the securing means can include an adhesive pull strip 240, as described above, though any of the other embodiments of the pull tab or the securing means described herein can be used. The adhesive pull strip 240 is fixed on an outside surface 127 of the sheet 120 at a vertex corner 121, and a direction of roll is from a proximal side edge 122 located opposite to the vertex corner 121, as shown in FIG. 14. The sheet 120 is rolled along this proximal side edge 122 to create spiral layers 128 as shown in FIGS. 15 and 16. FIG. 17 shows the form of a cylinder 150 that is achieved by rolling the sheet 120.

Figure 19:
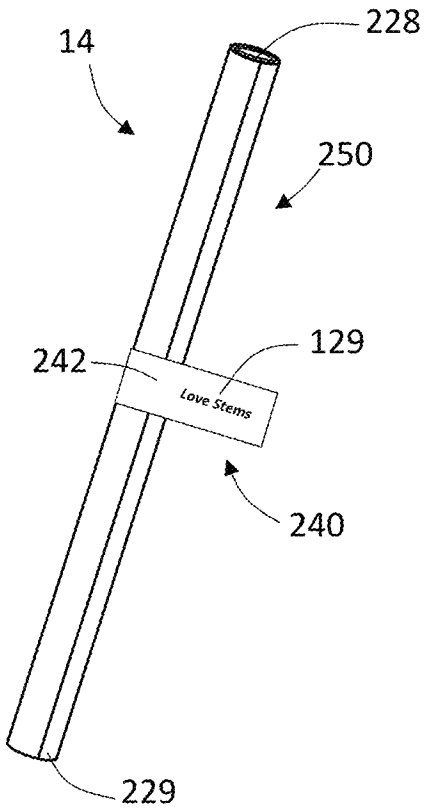
FIG. 19 the fully formed cylinder of FIG. 18 held in place with teh adhesive tab, securing the cylinder in position.
Figure 18:
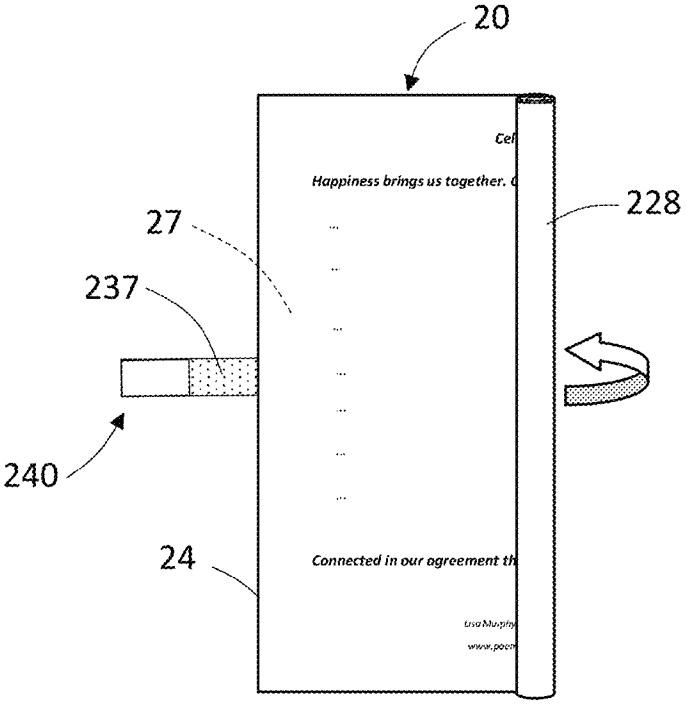
FIG. 18 shows a sheet rolled from a side edge toward the opposed side edge, with an adhesive tab along the opposed side edge.

FIGS. 18-19 show another alternative embodiment of a decorative greeting article 14, where the sheet 20 is rolled from a proximal side edge toward an opposed distal side edge 24 and into a plurality of spiral layers 228 that form a cylinder 250 where each of the lateral edges 229 of the layers 228 are co-extensive. In this embodiment, the pull tab and the securing means can include an adhesive pull strip 240, as described above, though any of the other embodiments of the pull tab or the securing means described herein can be used. The adhesive pull strip 240 is attached to the outside surface 27 of the sheet 20, roughly in the middle of the distal side edge 24 of the sheet 20. In this embodiment, a rolling force is applied along the proximal side edge of the sheet 20 to achieve the form of a cylinder 250 shown in FIG. 19. This cylinder 250 having co-extensive spiral layers with the side edges overlapped or registered with each other, resembles a scroll.

Figure 21:
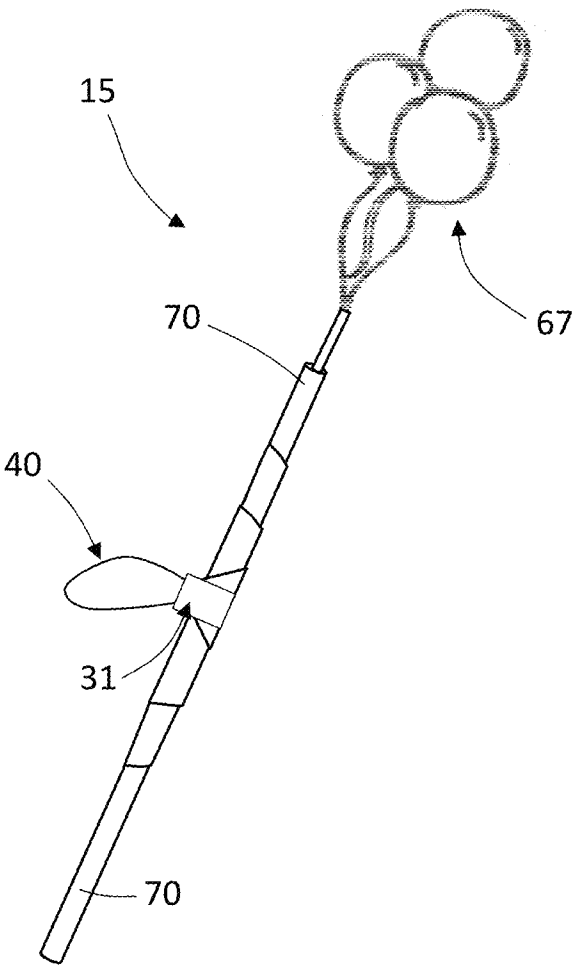
FIG. 21 shows the decorative greeting article of FIG. 20, with the sheet rolled and secured into a cylinder.
Figure 20:
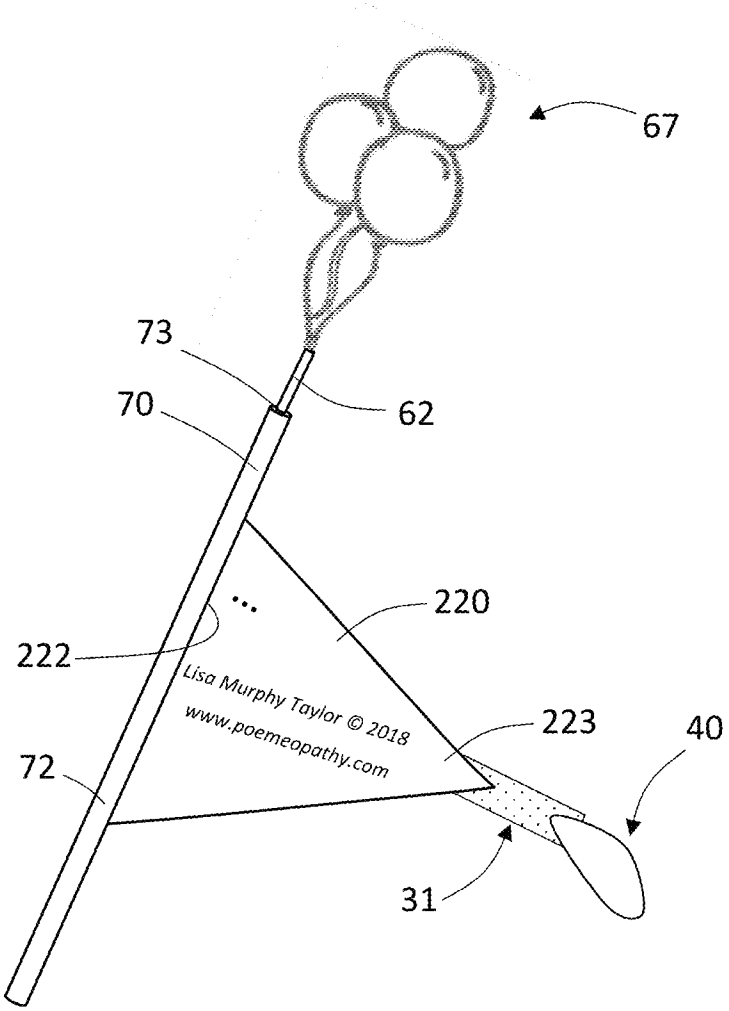
FIG. 20 shows an alternative embodiment of a decorative greeting article, having a triangular-shpaed sheet having a side edge affixed along the length of an elongated tube, and having a decorative item shown as a bunch of balloons.

FIGS. 20-21 show an alternative embodiment of the decorative greeting article 15 that includes an elongated cylindrical tube 70. The decorative item is shown as a bunch of balloons 67. The elongated cylindrical tube 70 has an outer surface 72, with an opening 73 at an upper end that communicates with the hollow interior of the tube 70. In this embodiment, the pull tab and the securing means can include an adhesive strip 31 and tab member 40, as described above, though any of the other embodiments of the pull tab or the securing means described herein can be used. A triangular-shaped sheet 220 has a base edge 222 that is attached along the length of the outer surface 72 of the tube 70, to extend therefrom in an unrolled position as shown in FIG. 20. The elongated cylindrical tube 70 can be made of resilient material that can include, but is not limited to, a cardboard, a paper, a plastic film, aluminum or other metal, or a combination or laminate thereof. As described herein above, a stem 62 having attached thereto the bunch of balloons 67, can be inserted through the opening 73 and into the hollow interior of the tube 70. The sheet 220 is substantially as described herein above for the embodiment of the sheet 120 of the decorative greeting article 13, shown in FIGS. 14-17. The tube 70 provides a permanent cylindrical body within which the decorative item 60 can remain while the sheet 220 with its inscription is unrolled and viewed by the user. In the illustrated embodiment, the securing means is an adhesive strip 31 and pull tab 40, as described herein above.

Figure 23:
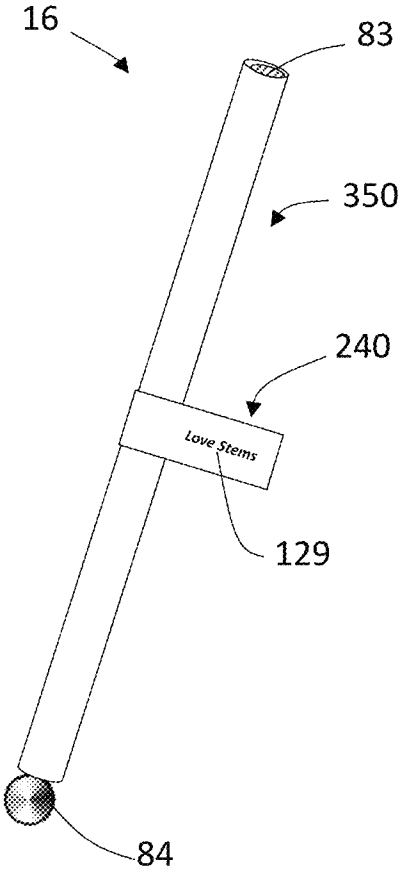
FIG. 23 show the decorative greeting article of FIG. 22, with the sheet rolled and secured into a cylinder over the tube.
Figure 22:
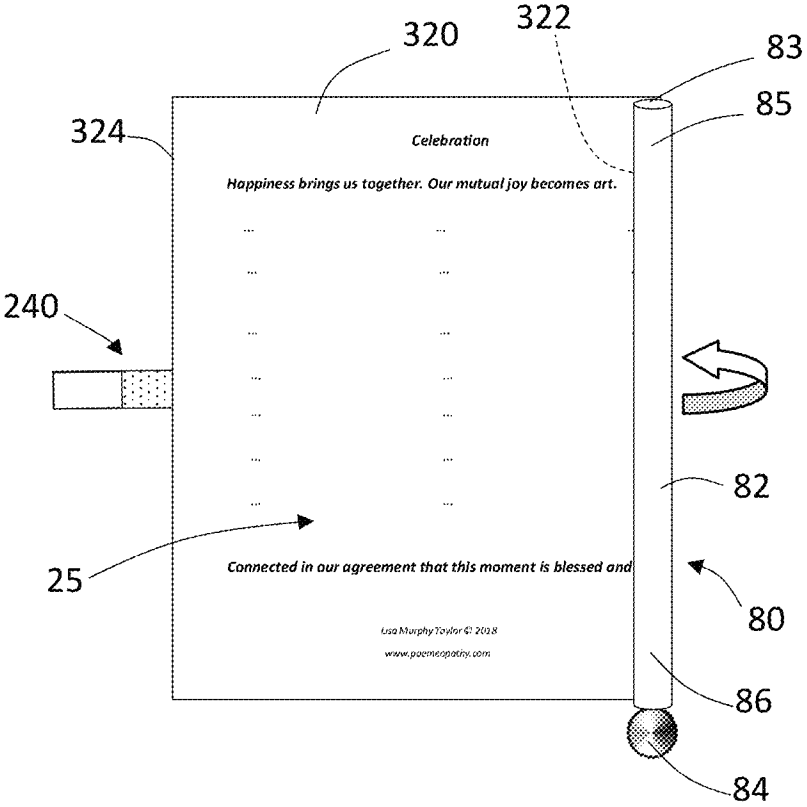
FIG. 22 shows the decorative greeting article, having a sheet having a side edge affixed along the length of an elongated tube that has a bottom handle.

FIGS. 22-23 show an alternative embodiment of the decorative greeting article 16 that includes an elongated cylindrical tube 80 having an outer surface 82, with an opening 83 at an upper end 85, and a handle 84 affixed at a lower end 86. In this embodiment, the pull tab and the securing means can include an adhesive pull strip 240, as described above, though any of the other embodiments of the pull tab or the securing means described herein can be used. A rectangular -shaped sheet 320 has a base edge 322 that is attached along its length to the length of the outer surface 82 of the tube 80, to extend therefrom in an unrolled position as shown in FIG. 22. The elongated cylindrical tube 80, and its handle 84, can be made any resilient material including, but not limited to, a cardboard, a paper, a plastic film, aluminum or other metal, or a combination or laminate thereof. The sheet 220 can be rolled in a plurality of layers 328 into a paper cylinder 350, and secured with a securing means, substantially as described herein above for the decorative greeting article 14 shown in FIGS. 18 and 19. The handle 84 can be rigidly fixed to the lower end 86 of the tube 80, or can be rotatably fixed, so that the handle 84 can be gripped and the tube is free to rotate about the handle 82, which can be accomplished by well-known means.

Figure 24:
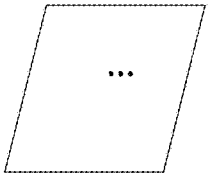
FIGS. 24 through 33 show alternative embodiments of the sheet according to the invention.
Figure 25:
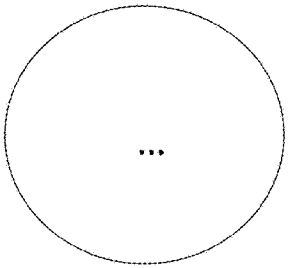
Figure 26:
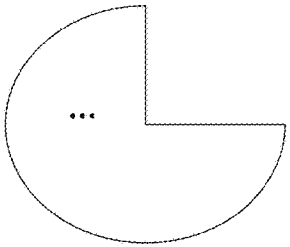
Figure 27:
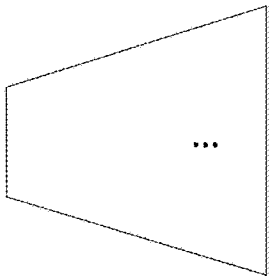
Figure 28:
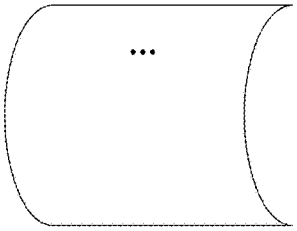
Figure 29:
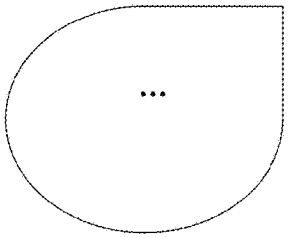
Figure 30:
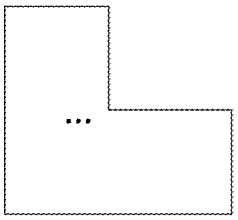
Figure 31:
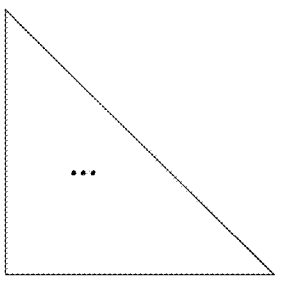
Figure 32:
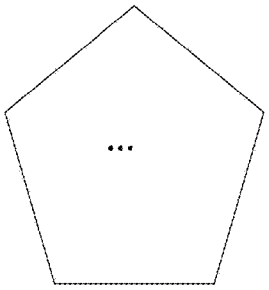
Figure 33:
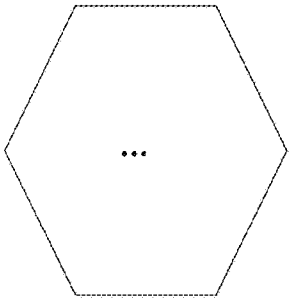

FIGS. 24-33 illustrate various non-limiting shapes of a sheet that can be used for the decorative greeting article of the present invention. Generally, each Sheet can be seen to have a proximal edge portion to which is attached or affixed a pull tab or adhesive pull strip, and a distal edge portion, from which the sheet can be rolled into a cylinder, as described herein above in greater detail. FIG. 24 shows a sheet 20 having a quadrilateral shape. FIG. 25 shows a sheet 20 having a circular shape. FIG. 26 shows a sheet 20 having a circular shape with a wedge removed. FIG. 27 shows a sheet 20 having a trapezoidal shape. FIG. 28 shows a sheet 20 in a shape recognized as a stored data symbol used in the field of flowcharts. FIG. 29 shows a sheet having the shape of a teardrop. FIG. 30 shows a sheet 20 that is L-shaped. FIG. 31 shows a sheet 20 having right-triangle shape, where the distal edge portion is along an edge of the right triangle. FIG. 32 shows a sheet having the shape of a pentagon. FIG. 33 shows a sheet having a shape of a hexagon. The shapes of a sheet mentioned herein are not limiting, and should not be construed to be exhaustive and other shapes of the sheet are also envisioned and form part of the invention.

Figure 34:
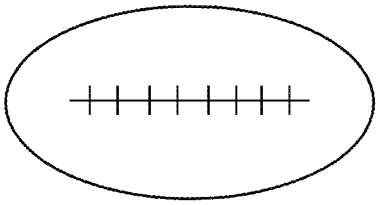
FIGS. 34 through 41 show alternative embodiments of a pull tab according to the invention.
Figure 35:
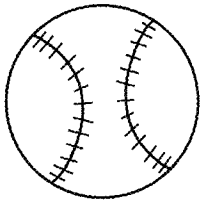
Figure 36:
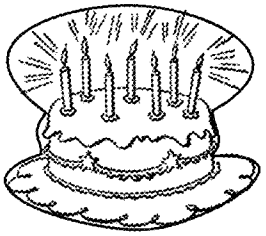
Figure 37:
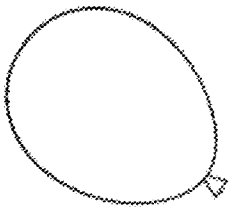
Figure 38:
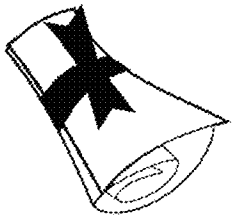
Figure 39:
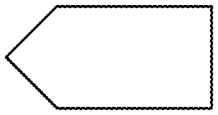
Figure 40:
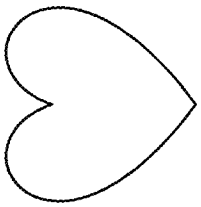
Figure 41:
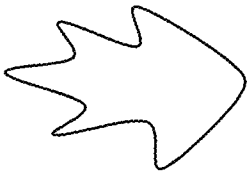

FIGS. 34-41 show various non-limiting examples for a shape of a pull tab. FIG. 34 shows a pull tab in the shape of a football. FIG. 35 shows a pull tab in the shape of a baseball. FIG. 36 shows a pull tab in the shape of a birthday cake. FIG. 37 shows a pull tab in the shape of a balloon. FIG. 38 shows a pull tab in the shape of a diploma. FIG. 39 shows a pull tab in the shape of a plain arrow. FIG. 40 shows a pull tab in the shape of a heart. FIG. 41 shows a pull tab in another shape of a leaf. Other non-limiting shapes can include a circle, a triangle, a trapezoid or rectangle, a pentagon, and a cross. The shapes of a pull tab mentioned herein should not be construed to be exhaustive and other shapes of the sheet are also envisioned and form part of the invention.

In the foregoing embodiments an inscription can be based on any notion known to man and in the art. In other words, it can take the form and shape of any matter that occurs in nature and in the art. In a preferred embodiment, the inscription is a poem that includes a poem topic, the poem, the name of the poem's author, and any other associated items like copyright notices or trademark notices or author correspondence details or the like. In a further preferred embodiment, the method used to inscribe the inscription includes embroidery, inkjet printing, laser printing, classic ink printing, vintage ink printing or any other method that may make perceivable the poem on the sheet.

In the foregoing embodiments, an inscription associated with the pull tab can be based on any notion known to man and in the art. It can take the form and shape of any matter that occurs in nature and in the art. In a preferred embodiment, the inscription on the pull tab could be the trademarked product name of the decorative greeting article. In other embodiments, this can be a phrase associated with the inscription inscribed on the inscription are of the sheet. In yet other embodiments, it can also include phrases associated with a topic of the inscription, the name of the author, or any other associated items like copyright notices or trademark notices or author correspondence details or the like. In a preferred embodiment, the method used to inscribe the inscription on the pull tab includes embroidery, inkjet printing, laser printing, classic ink printing, or any other method that may make perceivable the inscription on the pull tab. In other embodiments, the inscription on the pull tab can also include hand-written text. In few other embodiments, the inscription on the pull tab can include text that is hand-written or printed on a sticker which can be stuck onto the pull taK In foregoing embodiments including the preferred embodiment, the decorative item can include any novelty item, including items known in the art including, but not limited to, an items of nature including a natural or artificial flower, branch, twig, and stick, a flag, a balloon, a lollipop, a candy cane, a baby rattle, a windmill toy, a cat or dog toy, a golf tee, baseball bat, or other sports article, a heart, a cigar, an umbrella handle, a magic of fairy wand, and the like.

I claim:

1. A decorative greeting article, including:

(a) a sheet of paper having an inscription thereupon, the sheet of paper having a proximal corner and an opposed distal corner, wherein the sheet of paper is configured to extend from the proximal corner to the diagonally-opposite distal corner at an unrolled position at which the inscription can be seen, and to be rolled from the proximal corner to the diagonally-opposite distal corner at a rolled position, wherein the sheet of paper is sufficiently resilient to form and retain an elongated rolled cylinder comprising two or more spiral layers of the sheet of paper, wherein the diagonally-opposite distal corner is rolled onto the outermost spiral layer of the sheet of paper, the rolled cylinder having a hollow interior, and an opening into the hollow interior at one end;

(b) a pull tab extending from the distal corner of the sheet, the pull tab including an adhesive strip for releasably attaching the distal corner of the sheet of paper onto the outermost spiral layer of the rolled cylinder in the rolled position, the adhesive strip having an adhesive inner surface along the entire length, the adhesive strip having a proximal end integrably attached to the distal corner of the sheet of paper, and an adhesive securing portion that releasably attaches to the outermost spiral layer of the rolled cylinder in the rolled position, wherein the adhesive securing portion of the adhesive strip is released from the outermost spiral layer when a pulling force sufficient is applied onto the pull tab that releases the distal corner of the sheet of paper from the outermost spiral layer of the rolled cylinder, for unrolling the sheet to its unrolled position; and (c) a decorative item having a stem removably inserted through the opening at the one end and into the hollow interior of the rolled cylinder.

2. The decorative greeting article of claim 1, wherein the adhesive inner surface comprises a pressure-sensitive adhesive.

3. The decorative greeting article of claim 1, wherein the pull tab comprises a separate tab member having a proximal edge, and a distal end of the adhesive strip is attached adhesively and integrably to the proximal edge of the pull tab.

4. The decorative greeting article of claim 1, wherein the pull tab is formed by a distal end of the adhesive strip that has been folded inwardly and over onto an adjacent portion of the adhesive strip, to form a self-adhered tab portion.

5. The decorative greeting article of claim 1, where the sheet of paper is scented.

6. The decorative greeting article of claim 1, wherein the inscription is selected from the group consisting of a mechanically-printed form, a hand-written form, an embroidered form, and a combination thereof.

* * * * *